US006295831B1

(12) United States Patent
Watson

(10) Patent No.: US 6,295,831 B1
(45) Date of Patent: Oct. 2, 2001

(54) CHILLING PITCHER

(75) Inventor: Chris A. Watson, Sturgeon Bay, WI (US)

(73) Assignee: 865 Investment Group LLC, Westchester, IL (US)

( * ) Notice: Subject to any disclaimer, the term of this patent is extended or adjusted under 35 U.S.C. 154(b) by 0 days.

(21) Appl. No.: 09/357,460

(22) Filed: Jul. 20, 1999

(51) Int. Cl.[7] ..... F25D 3/08
(52) U.S. Cl. ..... 62/457.3; 62/530; 220/592.16
(58) Field of Search ..... 62/457.3, 530; 220/504, 592.16

(56) References Cited

U.S. PATENT DOCUMENTS

| | | | | |
|---|---|---|---|---|
| 93,001 | | 7/1869 | Pietsch . | |
| 97,583 | | 12/1869 | Adler . | |
| D. 356,004 | | 3/1995 | Van Valkenburg | D7/317 |
| 515,632 | | 2/1894 | Wallace . | |
| 672,025 | | 4/1901 | Walsh et al. . | |
| 816,858 | * | 4/1906 | Ham . | |
| 1,519,034 | | 2/1924 | Livingston . | |
| 2,075,137 | | 3/1937 | Rosen | 62/91.5 |
| 2,362,223 | | 11/1944 | Platkin | 215/6 |
| 3,282,068 | | 11/1966 | Cain | 62/457 |
| 4,843,836 | | 7/1989 | Childers | 62/293 |
| 5,289,953 | * | 3/1994 | McMillan et al. . | |
| 5,299,433 | | 4/1994 | Harms et al. | 62/457.2 |
| 5,405,030 | | 4/1995 | Frazier | 215/6 |
| 5,487,486 | | 1/1996 | Meneo | 220/504 |
| 5,579,946 | * | 12/1996 | Rowan et al. . | |
| 5,732,567 | * | 3/1998 | Anderson | 62/530 X |
| 5,799,501 | | 9/1998 | Leonard et al. | 62/457.3 |
| 5,803,316 | * | 9/1998 | Couture . | |

* cited by examiner

*Primary Examiner*—William Doerrler
*Assistant Examiner*—Chen-Wen Jiang
(74) *Attorney, Agent, or Firm*—Wallenstein & Wagner, Ltd

(57) ABSTRACT

The present invention relates to a molded, one-piece, chilling pitcher with a compartment for holding a beverage, and an integral dividing wall that forms a wedge-shaped cooling chamber for holding a cooling medium such as ice. The main body of the pitcher is formed by a conical exterior wall and an integral base. The cooling chamber is formed between the arcuate shaped exterior wall and the dividing wall to produce a wedged-shaped configuration that facilitates the filling and emptying of ice into and from the chamber. This wedge-shape and the relatively wide radius of the dividing wall allow ice cubes or chips to be poured into the cooling chamber in a relatively compact manner, and allow the surface of the ice to flushly engage the surface of the dividing wall to improve the cooling rate of the pitcher. The arcuate shape of the dividing wall and wedge shape of the cooling chamber help minimize the volume of the cooling chamber and maximize the surface area of the dividing wall to facilitate the transfer of heat between the beverage and ice and improve the cooling rate or power of the pitcher. The sides of the dividing wall are integrally formed with the exterior wall of the pitcher to provide the structural stability to allow the dividing wall to extend to and be thinner and wider near the top of the pitcher to further improve the cooling rate and efficiency of the pitcher. The dividing wall is vertical or slightly pitched back to help prevent ice and water from spilling into the beverage compartment when pouring the beverage from the pitcher.

36 Claims, 2 Drawing Sheets

CHILLING PITCHER

TECHNICAL FIELD OF THE INVENTION

This invention relates to a chilling pitcher with a compartment for holding a beverage and an arcuate dividing wall that forms a wedge-shaped chamber for holding a cooling medium such as ice chips.

BACKGROUND OF THE INVENTION

During the warm summer months, many people enjoy being outside to enjoy a warm sunny day, a nice view or a refreshing breeze. Restaurants and bars have adapted to this preference by providing outdoor eating and gathering areas, as well as entertainment facilities such as volleyball courts and the like. Yet, most popular summer-time drinks are served and best enjoyed cold, or at temperatures below 50° Fahrenheit. Although the heat, sun and breeze accelerate the warming of these drinks, ordinary serving containers such as a glass or plastic pitcher are not designed to keep the beverage cool. While ice can be added to some beverages such as ice tea or lemon aid, the dilution of the beverage is not desired for other drinks such as beer or wine. The warming of the beverage is particularly problematic when a group of people orders several pitchers, because some of the pitchers may remain full for a period of time.

A variety of chilling pitchers have been designed to keep beverages cool. These pitchers typically have a multi-compartment design that includes a separate cooling compartment. Examples of such pitcher are shown in U.S. Pat. Nos. 93,001 to Pietsch, 672,025 to Walsh, 2,075,137 to Rosen, 2,362,223 to Platkin, 3,282,068 to Cain, 4,843,836 to Childers, 5,299,433 to Harms, 5,487,486 to Meneo, 5,732,567 to Anderson and 5,799,501 to Leonard, the contents of which are incorporated by reference herein. A cooling medium such as ice is placed in the cooling chamber. The beverage is cooled when heat flows from the beverage through the wall separating the two compartments and is absorbed by the ice. The ice then melts, and water accumulates at the bottom of the cooling compartment.

One problem with conventional chilling pitchers is the location and shape of the cooling compartment. The cooling compartment is frequently located in the center of the pitcher and projects up from the base so that the compartment is surrounded as much as possible by the beverage. This cantilevered structure is susceptible to cracking or breaking at the base. To add strength, some cooling compartment designs are given an inverted conical shape with a wider base and narrower top. Unfortunately, as the ice melts it falls away from the wall dividing the two compartments. The air pocket between the ice and the divider wall adds thermal resistance that decreases the cooling rate of the pitcher. The cold meted water also flows to the bottom of the cooling chamber and away from most of the divider wall contacting the beverage. This reduces the cooling efficiency of the pitcher.

Another problem with conventional chilling pitchers is that they fail to capitalize on the thermal heat exchange that can be achieved near the top of the pitcher. The cooling rate may even improve near the top of the pitcher because warmer masses tend to rise and a greater mass of liquid is located near the top of a conical pitcher. Yet, conventional chilling pitchers have divider walls with an incremental surface area that remains constant or decreases as the wall extends toward the top of the pitcher. In other words, the divider wall has proportionally the same or less surface area near the top of the pitcher than at the bottom. While this may be acceptable when a pitcher is almost empty, it is not appropriate to cool a full or nearly full pitcher.

A further problem with conventional chilling pitchers is that the divider wall has a uniform thickness from top to bottom. The thickness of the divider wall is not reduced near the top of the pitcher to reduce the thermal resistance of the wall and improve the cooling rate or efficiency of the pitcher.

A still further problem with conventional chilling pitchers is that the shape of the cooling compartment is not adapted to compactly receive the ice produced by many commercially available ice machines. The sharply curved walls forming the cylindrical or conical shaped cooling compartment do not readily accommodate square ice cubes or disc shaped ice chips in a compact manner. A great deal of air space remains when the ice cubes or chips are poured or scooped into the compartment, particularly near the top of a conical compartment. The surface of the ice does not tend to lay flush against the surface of the divider wall. Instead, a number of air pockets are formed along the surface of the divider wall, which decreases the cooling rate to the beverage. These drawbacks further reduce the cooling rate and efficiency of the pitcher.

A still further problem with conventional chilling pitchers is that they are not designed to develop convection currents that mix warm and cool masses of the beverage and maintained the beverage at a uniform temperature throughout the pitcher. By locating the cooling compartment near the bottom of the pitcher, the cooler mass of beverage settles and tends to stay near the bottom. Because the warmer mass of beverage rises and is not exposed to the cooling compartment, the warm beverage tends to stay near the top of the pitcher.

A still further problem with conventional chilling pitchers is that the cooling compartment has a narrow opening that makes them difficult to fill and empty. In some designs, the cooling compartment may even decrease in width or cross-sectional area near its opening. When the ice melts, the ice cubes and chips can fuse together to create a larger mass of ice. Should the pitcher be emptied before the mass of ice melts, the ice mass may be stuck inside the narrow opening of the cooling compartment. This can slow down the refilling of the cooling chamber and the reusing of the pitcher.

A still further problem with many conventional chilling pitchers is their multi-piece construction. Some designs have a cooling compartment that is separable from the rest of the pitcher. These designs present sanitary problems should the cooling compartment be handled improperly such as by setting it down on a dirty bar counter before placing it in the beverage. Other chilling pitcher designs locate the cooling compartment opening on the side or bottom of the pitcher and require a cover to close the cooling compartment during use to keep the ice falling out. The cover slows down the filling and refilling process, and requires a leek proof seal that inevitably wears out. These designs also inhibit the addition of ice to the cooling compartment during use. Still other chilling pitcher designs require a cap or lid to ensure that ice and water do not spill out of the cooling chamber when pouring the beverage into a glass or cup. When pouring the beverage, the divider wall reaches a horizontal position prior to emptying the pitcher, and ice and water would slide and flow across the wall and into the beverage unless stopped by the cap or lid. Each of these multi-piece designs increases the cost of the pitcher, and complicates the washing, drying and storing of the pitcher.

A still further problem with conventional chilling pitchers is that the centrally located cooling compartment makes it difficult to fill the beverage compartment via a commercial pressurized dispenser. The divider wall forming the compartment can cause the beverage to splatter out of the pitcher. The divider wall can also cause excessive foaming of a carbonated beverage and decrease the amount of beverage poured into the pitcher. Moreover, in commercial establishments, the server often sets the pitcher under a dispensing spout while filling the pitcher, and gathers glasses or other items needed by the customer. Conventional chilling pitchers can inhibit the productivity of the server by increasing the time and attention required to fill the pitcher.

The present invention is intended to solve these and other problems.

BRIEF DESCRIPTION OF THE INVENTION

The present invention relates to a molded, one-piece, chilling pitcher with a compartment for holding a beverage and an integral dividing wall that forms a wedge-shaped cooling chamber for holding a cooling medium such as ice. The main body of the pitcher is formed by a conical exterior wall and an integral base. The cooling chamber is formed between the conical exterior wall and the curved dividing wall to produce a wedged-shaped configuration that allows the chamber to be easily filled with or emptied of ice. The sides of the dividing wall are integrally formed with the exterior wall of the pitcher to provide structural stability that allows the dividing wall to extend to and be thinner and wider near the top of the pitcher to further improve the cooling rate and efficiency of the pitcher. The wedge-shape of the chamber and the relatively wide radius of the dividing wall allow ice cubes or chips to be poured into the cooling chamber in a relatively compact manner, and allow the surface of the ice to more flushly engage the surface of the dividing wall to improve the cooling rate of the pitcher. The wedge-shape also maintains the ice in contact with the dividing wall as the ice melts and slides down the chamber during use. The arcuate shape of the dividing wall also helps maximize its surface area to facilitate the transfer of heat between the beverage and ice and improve the cooling rate or power of the pitcher. The dividing wall is vertical or slightly pitched back to help prevent ice and water from spilling into the beverage compartment when pouring the beverage from the pitcher. A main advantage of the present invention is the shape and location of the cooling chamber. The wedge-shaped cooling chamber is formed on the side of the pitcher by the conical exterior wall of the pitcher and the integral arcuate dividing wall which extends substantially vertically from the base of the pitcher. The wedge-shaped chamber has a width or cross-sectional area that continuously increases toward the open top of the chamber. Ice can be easily poured into the chamber before, during or after filling the beverage compartment. The smooth walls forming the cooling chamber and its continuously increasing wedge-shape ensures that a fused mass of ice will not become caught in the chamber. Should the pitcher need to be emptied before the mass of ice melts, the pitcher need only be turned up side down.

Another advantage of the present chilling pitcher invention is that it capitalizes on thermal exchange near the top of the pitcher. The cooling rate near the top of the pitcher should be better because the warmer mass of beverage in the pitcher tends to rise and more beverage is located near the top of the conical pitcher. The dividing wall is wider near the top of the pitcher so that its incremental or proportional surface area increases toward the top of the pitcher. Accordingly, the inventive design is appropriate for a completely or partially full pitcher.

A further advantage of the present chilling pitcher invention is that the arcuate shape of the dividing wall allows the beverage compartment to hold a greater volume of beverage while providing an increased cooling rate to the beverage. The arcuate shape of the dividing wall increases its surface area in contact with the ice and beverage, without increasing the volume of the cooling chamber. The increase in surface area to chamber volume ratio allows the pitcher to hold more beverage while increasing the cooling rate of the pitcher.

A further advantage of the present chilling pitcher invention is that the dividing wall is thinner near the top of the pitcher. This thinning reduces the thermal resistance of the wall and improves the cooling rate and efficiency of the pitcher.

A still further advantage of the present chilling pitcher invention is that the shape of the cooling compartment is adapted to compactly receive the ice produced by many conventional ice machines. The relatively wide radius of the dividing wall accommodates ice cubes in a compact manner, particularly disc shaped ice chips. Little air space remains when the ice cubes or chips are poured or scooped into the cooling chamber. In addition, the surface of the ice tends to lay flush against the surface of the dividing wall, which increases the cooling rate to the beverage. The ice is maintained in flush contact with the dividing wall because it slides down in the wedge as it melts. These advantages improve the cooling rate and efficiency of the pitcher.

A still further advantage of the present chilling pitcher invention is that it helps develop convection currents that mix warm and cool masses of the beverage and maintain the beverage at a uniform temperature throughout the pitcher. The proportionally large amount of the dividing wall and the cooling chamber is located near the top of the pitcher. The warmer mass of beverage near the cooling chamber is cooled and tends to settle to the bottom of the pitcher. The mass of beverage near the exterior wall of the pitcher is warmed and tends to rise to the top of the pitcher. This should create a convection current that spans the entire height of the pitcher to keep the beverage at a relatively uniform temperature throughout the pitcher.

A still further advantage is that the pitcher can be completely emptied of beverage without spilling the ice and water in the ice chamber. The pitcher has a conical exterior wall which slops outwardly from the centerline of the pitcher toward its top end. The slope of the exterior wall is greater than the substantially vertical dividing wall. When the pitcher is tilted, the beverage completely empties from the beverage compartment before the dividing wall reaches a horizontal position. When properly handled, the ice and water in the chamber should not spill into the beverage. No caps or lids are needed, and manufacturing costs, storing space and washing time are reduced.

A still further advantage of the present chilling pitcher invention is its one-piece construction. The cooling compartment is an integral part of the pitcher. Once the pitcher is properly washed, it can be set on its base without jeopardizing the sanitary condition of the cooling compartment. In addition, ice and water are kept in the cup shaped cooling chamber without the need of a cover or seal to close the compartment. Moreover, ice can easily be added to the cooling compartment during use.

A still further advantage of the present chilling pitcher invention is that the cooling chamber is located to one side of the pitcher. The majority of area forming the top end of the pitcher is available for filling the pitcher with a beverage. The cooling chamber does not obstruct this area. The beverage can be easily dispensed into the pitcher by a conventional commercial pressurized dispenser without splattering or producing excessive foam. Dispensed beverage that is inadvertently poured over the thin upper edge of the dividing wall should simply run down the wall and into the beverage compartment or cooling chamber. The server is free to gather glasses or other items needed by the customer, without undue attention to filling the pitcher.

Other aspects and advantages of the invention will become apparent upon making reference to the specification, claims and drawings.

DESCRIPTION OF THE PREFERRED EMBODIMENTS

Figure 1:
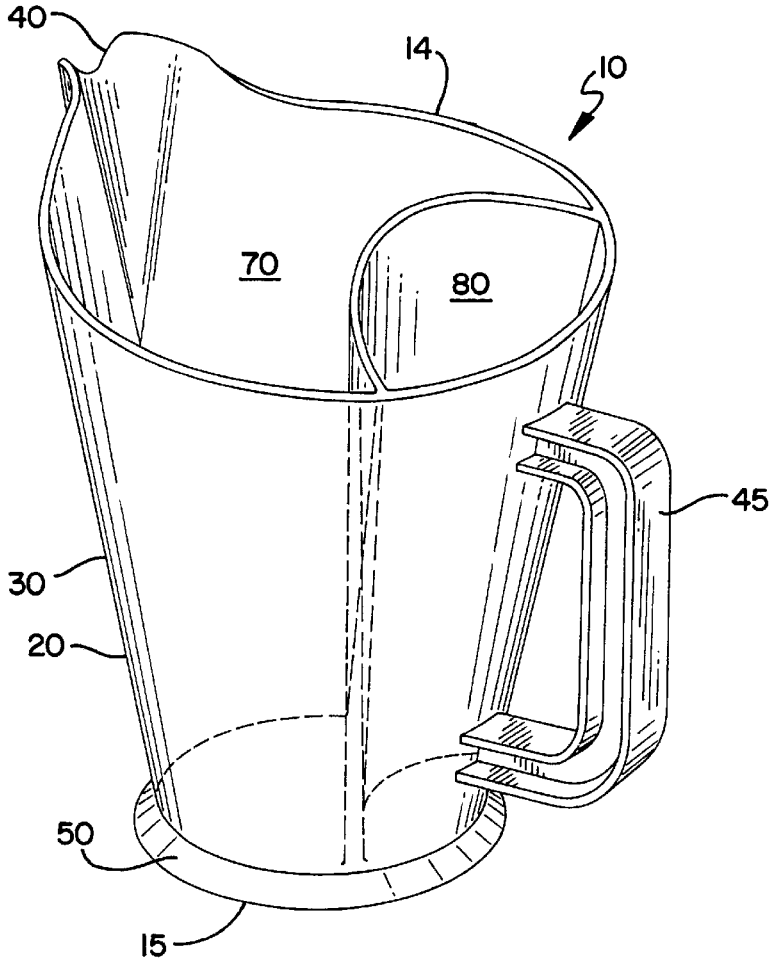
FIG. 1 is a perspective view of the present chilling pitcher invention showing the conical shape of the exterior wall and the arcuate dividing wall that separate the beverage compartment from the cooling chamber.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

As shown in FIGS. 1–4, the present invention relates to a chilling pitcher 10 for holding and maintaining a beverage at a cool temperature. The pitcher 10 has front 12 and rear 13 sides, an open top 14 and a bottom 15 that is adapted to rest on a flat supporting surface (not shown). The pitcher has a single piece construction that is preferably molded from plastic, such as commercially available styrene based plastic, and can be manufactured using conventional hot-molding techniques. However, it should be understood that other materials may be used without departing from the broad aspects of the invention. The plastic material cools into a rigid, semi-shatter proof structure with a preferably transparent appearance.

Figure 2:
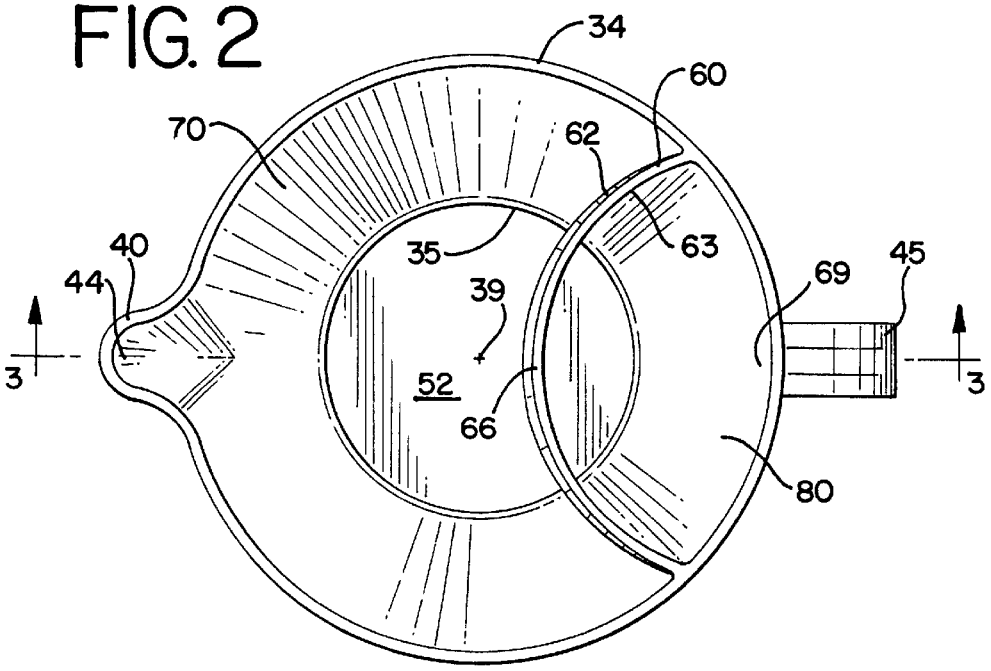
FIG. 2 is a top view of the chilling pitcher showing the general arrangement of the exterior wall, base, dividing wall, spout and handle.
Figure 3:
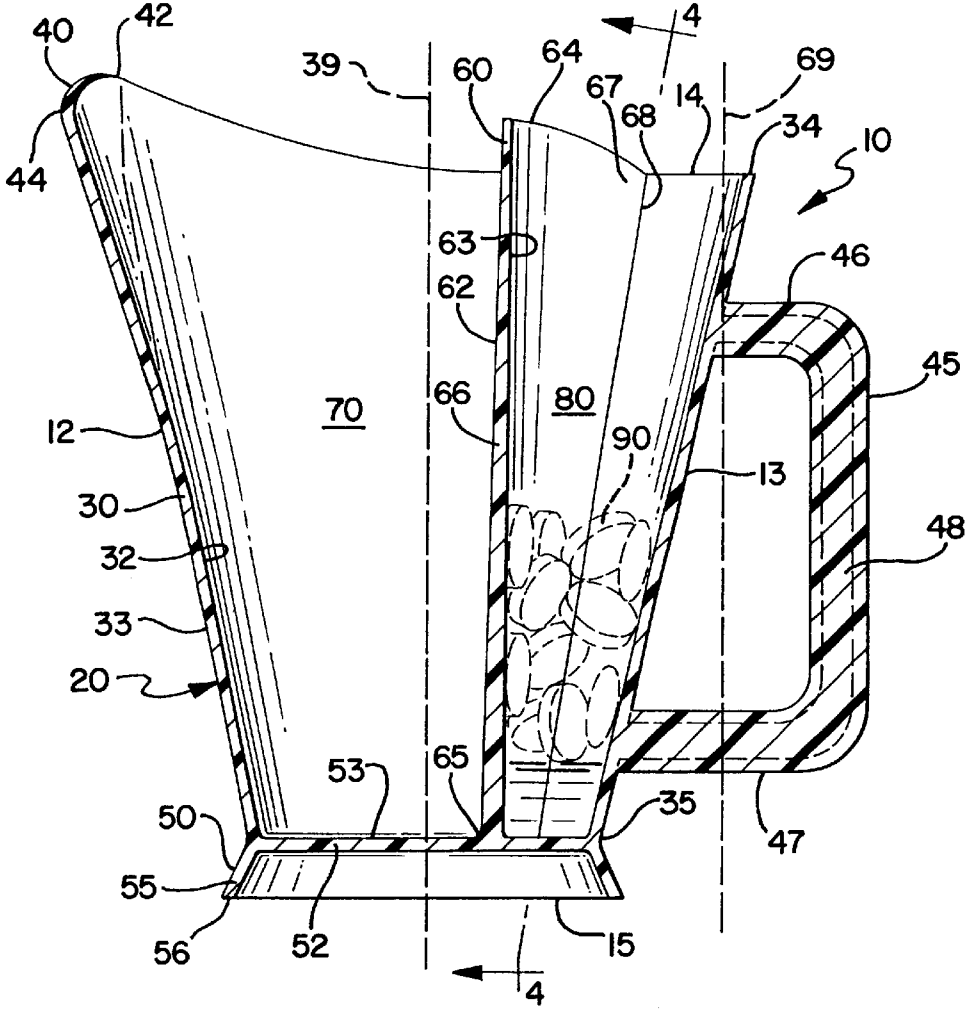
FIG. 3 is a side sectional view of the chilling pitcher taken along line 3—3 showing the sloped exterior wall, the substantially vertical and increasing thickness of the dividing wall, and cooling chamber partially filled with disc shaped ice chips.

As shown in FIGS. 1–3, the pitcher 10 has a main body 20 that includes an exterior wall 30 and a base 50. The exterior wall 30 has smooth inner 32 and outer 33 surfaces, an upper end or rim 34 and a lower end 35. The upper end 34 is open to receive the beverage. The lower end 35 is closed by the base 50. The wall 30 has a conical shape with about a six-inch diameter at its upper end 34 and a three and a half inch diameter at its lower end 35. The conical exterior wall 30 is sloped about 10° to 15° from its central axis 39. This angle is uniform throughout exterior wall 30 except for a portion forming a spout 40. The exterior wall 30 has a generally uniform thickness of about ⅛ inch, but is slightly thicker around the rim 34 for added strength. Although the exterior wall 30 is shown and described as being conical, it should be recognized that the wall could have other shapes without departing from the broad aspect of the invention.

The spout 40 is integrally formed at the front 12 of the pitcher 10 in the upper end 34 of the exterior wall 30. The spout 40 is formed by two spaced waved edges 42 that join to form a central channel 44. As best shown in FIG. 3, the spout 40 has a slope of about 20° from the central axis 39, which is greater than that of the remainder of the exterior wall 30. A handle 45 is integrally formed at the rear 13 of the pitcher 10 to extend from the outer surface 33 of the exterior wall 30 directly opposite the spout 40. The handle 45 has upper 46 and lower 47 extensions joined by and a vertical grip 48. Extension 46 is somewhat shorter to compensate for the slope of the conical wall 20.

The base 50 forms the bottom end 15 of the pitcher 10. The base 50 includes a flat base plate 52 that is integrally molded to the lower end 35 of the exterior wall 30 around its perimeter. The base plate 52 has a flat, smooth inner surface 53. An integrally molded, downward extending flange or sleeve 55 elevates the base plate 52 from the supporting surface. The flange 55 extends downwardly from the perimeter of the base plate 52, and gradually increases in size at its outer end 56. The flange 55 creates an air pocket between the base plate 52 and the supporting surface to reduce the heat transfer between the beverage and that surface. The base plate 52 has a generally uniform thickness about equal to that of the exterior wall 30, and a diameter equal to that of the lower end 35 of the exterior wall.

A dividing wall 60 is located inside the pitcher 10 toward its rear side 13. The dividing wall 60 has inner 62 and outer 63 surfaces, a top 64 and bottom 65 ends, a middle 66 and two sides 67. The inner 62 and outer 63 surfaces are smooth and free of obstructions. The bottom 65 of the dividing wall 60 is integrally molded to the inner surface 53 of the base 50, and the sides 67 are integrally molded to the inner surface 32 of the conical wall 30 at spaced apart locations. The dividing wall 60 extends substantially vertically from the base 30 and through the open top 14 of the pitcher 10. The middle 66 of the dividing wall 60 extends above the rim 34 of the exterior wall 10.

The pitcher 10 is preferably a one-piece construction with the dividing wall integrally molded to the main body 20 of the pitcher. The bottom 65 of the dividing wall 60 is integrally formed to the base 50 to form a continuous bottom seam that spans the width of the base. The sides 67 join with the exterior wall 30 to form two side seams that progress straight up the entire height of the exterior wall. The side seams combine with the side seams to form a continuous leak-proof seam 68 along the intersection of the dividing wall 60 with the base 50 and exterior wall 30. The continuous seam 68 and the divider wall 60 combine to form a leak proof barrier that divides the inside of the pitcher 10 into separate compartments as discussed below. While the dividing wall is shown and described to be integrally formed to the base and exterior wall, it should be understood that the dividing wall could be joined to the base and wall in other manners without departing from the broad aspects of the invention.

The dividing wall 60 gradually and continually decreases in thickness as it extends from the base 50 toward the top of the pitcher 5. The dividing wall is about 3⁄16 inch thick at its bottom end 63 and about 1⁄16 inch at its top end 62. The inner surface 62 of the dividing wall 60 is pitched back about 1° from vertical towards the rear 7 of the pitcher 10. This 1° pitch in the inner surface 62 is believed to be caused by the shrinking of the plastic during the cooling phase of the molding process. The pitch of the inner surface 62 and the substantially vertical orientation of the outer surface 63 account for the changing thickness of the dividing wall.

The dividing wall 60 has an arcuate or curved shape when viewed from above as seen in FIG. 2. The dividing wall 60 has a convex shape relative to the rear portion of the exterior wall 30 between the side seams where the walls join together. The curve preferably has a constant radius about a central axis 69. The radius of the curve in the dividing wall 60 is about two and a half inches. This radius is preferably the same from the top 64 to the bottom 65 of the dividing wall 60 along axis 69, which is preferably parallel to the central axis 39 of the exterior wall 30, as shown in FIGS. 2 and 3. The radius of the inner surface 62 gradually decreases toward the top 64 of the dividing wall 60 due to the decreasing thickness of the wall and 1° pitch of the inner surface 62.

The construction of the pitcher 10 is such that each of its sides is symmetrical to the other. A line of symmetry extends from the front 12 of the pitcher to its rear 13. This line of symmetry passes through the channel 44 of the spout 40, the central axis 39 of the conical exterior wall 30, the middle 66 and central axis 69 of the dividing wall 60, and the handle 45.

As best shown in FIGS. 1–3, the dividing wall 60 divides the inside of the pitcher into two separate and distinct compartments. The major compartment located toward the front 12 of the pitcher 10 is a beverage compartment 70 for receiving a dispensed beverage. The smaller portion chamber located toward the rear 13 of the pitcher 10 is a cooling chamber 80 for receiving a cooling medium such as ice cubes or disc shaped ice chips 90. As noted above, the dividing wall 60 separates the beverage in compartment 70 from the cooling chamber 80 so that the beverage does not mix with the ice and water. The beverage compartment 70 is formed by the inner surface 32 of the exterior wall 30, the base plate 52, and the inner surface 62 of the dividing wall 60. Compartment 70 is sized to hold about 60 ounces of beverage. The cooling compartment 80 is formed by inner surface 32 of the exterior wall 30, a small rear portion of the base plate 52, and the outer surface 63 of the dividing wall 60.

Figure 4:
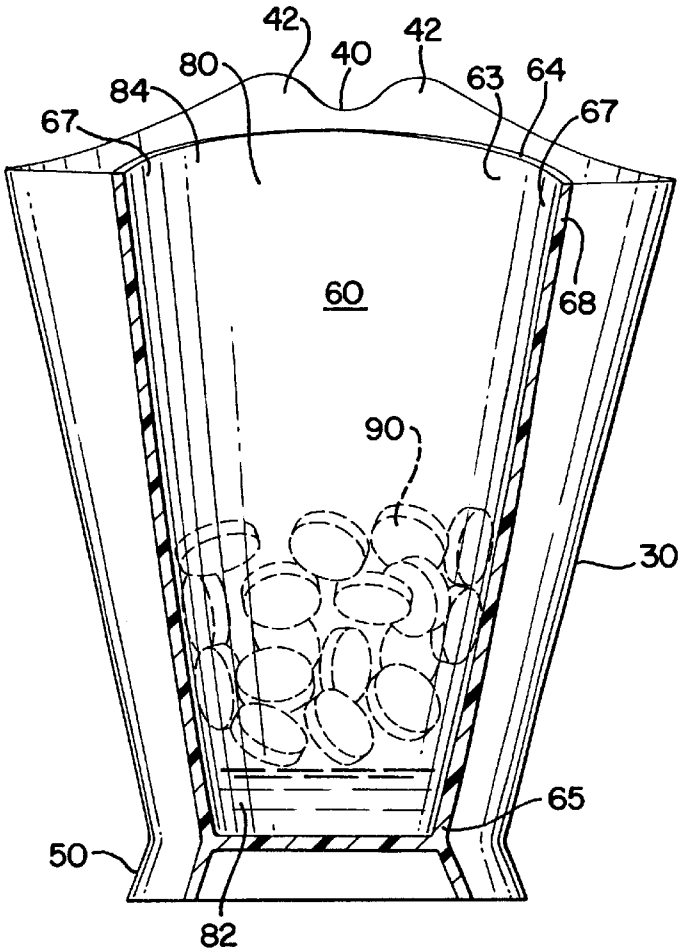
FIG. 4 is a front sectional view of the chilling pitcher taken along line 4—4 showing the incrementally or proportionally increasing surface area of the dividing wall as it extends toward the top of the pitcher.

The cooling chamber 80 has an open top for filling and emptying ice 90, and extends the complete height of the pitcher 5. As best shown in FIG. 4, the dividing wall 60 gradually and continuously widens from its lower end 65 to its upper end 64. This widening is caused by the substantially vertical orientation of the dividing wall 60 and the 10° to 15° slope of the conical exterior wall 30. The shape and orientation of the exterior wall 30 and dividing wall 60 causes the cross-sectional area of the wedged-shaped chamber 80 to gradually and continuously increase from its lower end 82 to its upper end 84. The relatively large radius of the curve of the dividing wall 60, allows pieces of ice, such as the disk-shaped ice chips 90 shown in FIG. 2, to more readily lay flat against the outer surface 63 of the wall. This allows more of the surface of the ice 90 to come into direct contact with the outer surface 63 of the dividing wall 60, reducing the number and size of the air pockets between the ice and the outer surface, decreasing the thermal resistance between the ice and beverage, and increasing the cooling rate to the beverage.

During use, the surface of the ice 90 in contact with the exterior wall 30, base 50 and dividing wall 60 melts. As the ice 90 melts, it tends to slide down the walls 30 and 60 toward the base 30. The downwardly narrowing or wedge-shape of the chamber 80 helps keep the surface of the ice 90 in direct contact with the outer surface 63 of the dividing wall so that the cooling rate to the beverage is maintained. When the beverage in the pitcher 10 has been consumed, the upwardly expanding shape of the chamber 80 ensures that any remaining ice 90 can be easily removed by simply turning the pitcher upside down, even if the ice has melted together into a single solid mass.

While the invention has been described with reference to a preferred embodiment, it will be understood by those skilled in the art that various changes may be made and equivalents may be substituted without departing from the broader aspects of the invention.

I claim:

1. A chilling pitcher for holding and cooling a beverage, said chilling pitcher comprising:

a main body formed by an exterior wall and a base, said exterior wall having an inner surface, a bottom end and an open top end, and said base having an inner surface;

a dividing wall having top and bottom ends, opposed sides, and inner and outer surfaces, said bottom end of said dividing wall being integrally molded to said inner surface of said base, and said opposed sides of said dividing wall being integrally molded at spaced apart locations to said inner surface of said exterior wall;

a beverage compartment formed by said inner surface of said exterior wall, said inner surface of said bottom wall and said inner surface of said dividing wall; and, a wedge-shaped cooling chamber formed by said inner surface of said exterior wall and said outer surface of said dividing wall, said cooling chamber having upper and lower ends, said cooling chamber having a cross-sectional area that continuously increases as it extends from its said lower end toward its said upper end.

2. The chilling pitcher of claim 1, and wherein said exterior wall has a conical shape that is wider at its said top end than at its said bottom end.

3. The chilling pitcher of claim 2, and wherein said dividing wall has a convex shape relative to said exterior wall between said spaced apart locations.

4. The chilling pitcher of claim 3, and wherein said convex shape of said dividing wall has a radius of about one to two times the radius of said exterior wall.

5. The chilling pitcher of claim 4, and wherein said conical exterior wall has a central axis, and said convex dividing wall defines a second axis extending from said top toward said bottom of said dividing wall, said second axis being parallel to said central axis.

6. The chilling pitcher of claim 1, and wherein said dividing wall is thinner toward its said top end and thicker toward its said bottom end.

7. The chilling pitcher of claim 1, and wherein said dividing wall has proportionally more surface area near its said top end than near its said bottom end.

8. The chilling pitcher of claim 1, and wherein said exterior wall has a front portion with an integrally formed spout and a rear portion with an integrally formed handle, and said wedge-shaped cooling chamber is located adjacent said handle.

9. The chilling pitcher of claim 8, and wherein said dividing wall has a middle, and said exterior wall has a central axis, and said chilling pitcher is symmetrical about a line passing through said spout, central axis, middle, and handle.

10. The chilling pitcher of claim 1, and wherein said bottom end of said dividing wall is integrally molded to said base and said opposed sides are integrally molded to said exterior wall to form a continuous leak proof seam.

11. A chilling pitcher for holding and cooling a beverage, said chilling pitcher comprising:

a main body formed by an exterior wall and a base, said exterior wall having an inner surface, a bottom end and an open top end, and said base having an inner surface;

a dividing wall having top and bottom ends, opposed sides, and inner and outer surfaces, said bottom end of said dividing wall being joined to said inner surface of said base, and said opposed sides of said dividing wall being joined at spaced apart locations to said inner surface of said exterior wall, said dividing wall being thinner toward its said top end and thicker toward its said bottom end;

a beverage compartment formed by said inner surface of said exterior wall, said inner surface of said bottom wall and said inner surface of said dividing wall; and, a cooling chamber formed by said inner surface of said exterior wall and said outer surface of said dividing wall.

12. The chilling pitcher of claim 11, and wherein said exterior wall has a conical shape that is wider at its said top end than at its said bottom end.

13. The chilling pitcher of claim 11, and wherein said dividing wall has a convex shape relative to said exterior wall between said spaced apart locations.

14. The chilling pitcher of claim 13, and wherein said convex shape of said dividing wall has a radius of about one to two times the radius of said exterior wall.

15. The chilling pitcher of claim 14, and wherein said conical exterior wall has a central axis, and said convex dividing wall defines a second axis spanning from said top to said bottom of said dividing wall, said second axis being parallel to said central axis.

16. The chilling pitcher of claim 11, and wherein said cooling chamber has upper and lower ends, and said cooling chamber is wedged-shaped with a cross-sectional area that continuously increases as it extends from said lower end toward its said upper end.

17. The chilling pitcher of claim 11, and wherein said dividing wall has proportionally more surface area near its said top end than near its said bottom end.

18. The chilling pitcher of claim 11, and wherein said exterior wall has a front portion with an integrally formed spout and a rear portion with an integrally formed handle, and said wedge-shaped cooling chamber is located adjacent said handle.

19. The chilling pitcher of claim 18, and wherein said dividing wall has a middle, and said exterior wall has a central axis, and said chilling pitcher is symmetrical about a line passing through said spout, central axis, middle, and handle.

20. The chilling pitcher of claim 11, and wherein said bottom end of said dividing wall is integrally formed to said base and said opposed sides are integrally formed to said exterior wall to form a continuous leak proof seam.

21. A chilling pitcher for holding and cooling a beverage, said chilling pitcher comprising:

a main body formed by an exterior wall and a base, said exterior wall having an inner surface, a bottom end and an open top end, and said base having an inner surface;

a dividing wall having top and bottom ends, opposed sides, and inner and outer surfaces, said bottom end of said dividing wall being integrally molded to said inner surface of said base, and said opposed sides of said dividing wall being integrally molded at spaced apart locations to said inner surface of said exterior wall, and said dividing wall has proportionally more surface area near its said top end than near its said bottom end;

a beverage compartment formed by said inner surface of said exterior wall, said inner surface of said bottom wall and said inner surface of said dividing wall; and, a cooling chamber formed by said inner surface of said exterior wall and said outer surface of said dividing wall.

22. The chilling pitcher of claim 21, and wherein said exterior wall has a conical shape that is wider at its said top end than at its said bottom end.

23. The chilling pitcher of claim 21, and wherein said dividing wall has a convex shape relative to said exterior wall between said spaced apart locations.

24. The chilling pitcher of claim 23, and wherein said convex shape of said dividing wall has a radius of about one to two times the radius of said exterior wall.

25. The chilling pitcher of claim 24, and wherein said conical exterior wall has a central axis, and said convex dividing wall defines a second axis extending from said top toward said bottom of said dividing wall, said second axis being parallel to said central axis.

26. The chilling pitcher of claim 21, and wherein said dividing wall is thinner toward its said top end and thicker toward its said bottom end.

27. The chilling pitcher of claim 21, and wherein said cooling chamber has upper and lower ends, and said cooling chamber is wedged-shaped with a cross-sectional area that continuously increases as it extends from said lower end toward its said upper end.

28. The chilling pitcher of claim 21, and wherein said exterior wall has a front portion with an integrally formed spout and a rear portion with an integrally formed handle, and said wedge-shaped cooling chamber is located adjacent said handle.

29. The chilling pitcher of claim 28, and wherein said dividing wall has a middle, and said exterior wall has a central axis, and said chilling pitcher is symmetrical about a line passing through said spout, central axis, middle, and handle.

30. The chilling pitcher of claim 21, and wherein said bottom end of said dividing wall is integrally molded to said base and said opposed sides are integrally molded to said exterior wall to form a continuous leak proof seam.

31. A chilling pitcher for holding and cooling a beverage, said chilling pitcher comprising:

a main body formed by a conical shaped exterior wall and a base, said exterior wall having an inner surface, a bottom end and an open top end, said base having an inner surface, and said conical shaped exterior wall being wider at its said top end than at its said bottom end;

a dividing wall having top and bottom ends, opposed sides, and inner and outer surfaces, said bottom end of said dividing wall being joined to said inner surface of said base, said sides of said dividing wall being joined at spaced apart locations to said inner surface of said exterior wall, said dividing wall having proportionally more surface area and being thinner in thickness near its said top end than near its said bottom end, and said bottom end of said dividing wall being integrally formed to said base and said opposed sides being integrally formed to said exterior wall to form a continuous leak proof seam;

a beverage compartment formed by said inner surface of said exterior wall, said inner surface of said bottom wall and said inner surface of said dividing wall; and, a wedge-shaped cooling chamber formed by said inner surface of said exterior wall and said outer surface of said dividing wall, said cooling chamber having upper and lower ends, said cooling chamber having a cross-sectional area that continuously increases as it extends from its said lower end toward its said upper end.

32. The chilling pitcher of claim 31, and wherein said dividing wall has a convex shape relative to said exterior wall between said spaced apart locations.

33. The chilling pitcher of claim 32, and wherein said convex shape of said dividing wall has a radius of about one to two times the radius of said exterior wall.

34. The chilling pitcher of claim 33, and wherein said conical exterior wall has a central axis, and said convex dividing wall defines a second axis extending from said top toward said bottom of said dividing wall, said second axis being parallel to said central axis.

35. The chilling pitcher of claim 31, and wherein said exterior wall has a front portion with an integrally formed spout and a rear portion with an integrally formed handle, and said wedge-shaped cooling chamber is located adjacent said handle.

36. The chilling pitcher of claim 35, and wherein said dividing wall has a middle, and said exterior wall has a central axis, and said chilling pitcher is symmetrical about a line passing through said spout, central axis, middle, and handle.

* * * * *